US008893956B1

(12) United States Patent
Knowlton

(10) Patent No.: US 8,893,956 B1
(45) Date of Patent: Nov. 25, 2014

(54) REFRIGERANT CHARGE SLIDE CALCULATOR

(71) Applicant: Bryan T Knowlton, San Angelo, TX (US)

(72) Inventor: Bryan T Knowlton, San Angelo, TX (US)

( * ) Notice: Subject to any disclaimer, the term of this patent is extended or adjusted under 35 U.S.C. 154(b) by 79 days.

(21) Appl. No.: 13/784,828

(22) Filed: Mar. 5, 2013

Related U.S. Application Data

(60) Provisional application No. 61/634,634, filed on Mar. 5, 2012.

(51) Int. Cl.
*G06G 1/00* (2006.01)
*G06C 1/00* (2006.01)

(52) U.S. Cl.
CPC ..... *G06C 1/00* (2013.01)
USPC ..... 235/70 A; 235/70 R

(58) Field of Classification Search
USPC ..... 235/70 A, 70 R; 702/50
See application file for complete search history.

(56) References Cited

U.S. PATENT DOCUMENTS

| | | | | |
|---|---|---|---|---|
| 2,597,609 | A | 5/1952 | Bartlet et al. | |
| 4,772,780 | A | 9/1988 | Reed et al. | |
| 7,979,996 | B2 | 7/2011 | Adams, Jr. et al. | |
| 2011/0066389 | A1 * | 3/2011 | Weick | 702/50 |

* cited by examiner

*Primary Examiner* — Kristy A Haupt
(74) *Attorney, Agent, or Firm* — Handley Law Firm, PLLC

(57) ABSTRACT

A refrigerant slide calculator for determining proper refrigerant charge displays on a single side representations for performance characteristics, measured temperatures and pressures for more than one refrigerant, preferably both R22 and R410a. The slide calculator has an operator a sleeve, with the operator being a card which slidably fits within the sleeve. The operator has superheat data areas and subcooling data areas. The sleeve has different portions defined as a superheat region and a subcooling region, with windows matching the various measured wet bulb and dry bulb temperatures. In the superheat region, vapor pressure windows are provided which correspond to the different refrigerants, and a singular required vapor line temperature is displayed corresponding required superheat. In the subcooling region, a required liquid line temperature window and required subcooling data field are provided along with a liquid pressure window representing two different refrigerants.

5 Claims, 13 Drawing Sheets

29
26
SuperHeat NON-TXV
SuperCool
SLIDE RULE
92
A
(SEE FIG. 3A)
B
(SEE FIG. 3B)
C
(SEE FIG. 3C)
D
(SEE FIG. 3D)
E
(SEE FIG. 3E)
TXV
94
30

FIG. 3B

A

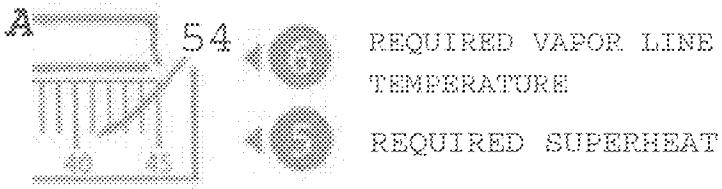

Use this method on units without a TXV

VISUALLY VERIFY there is not a TXV at the evaporator coil.

Measure indoor wet bulb temperature and outdoor dry bulb temperature

1. Set the indoor wet bulb temperature in area 1.
2. Locate the outdoor dry bulb temperature in area 2.
3. Record the required superheat directly to the right in area 3.
4. Measure the vapor line pressure and temperature at the condenser. Set the poi... in area 4 to the pressure measured at the condenser on the vapor (large) line. Use green box for R22 and pink for R410A. 82
5. Locate the previously recorded required superheat in area 3 and...
6. Note the required vapor line temperature directly above it in area 5. If the measured vapor line temperature is higher than the required vapor line temperature then ADD refrigerant to lower the temperature until the required line temperature is reached. If the measured line temperature is lower than the required line temperature you must first verify the system airflow is correct (check filter and evaporator coil and use formula printed on inside back flap). After all other possibilities have been eliminated, REMOVE refrigerant until the desired temperature is reached.

B Allow for 3° discrepancy.

FIG. 3C

2. Locate the Mfr's required subcooling on the equipment data plate (if missing use 8° to 10°). Locate this number in Area (B) then...

3. Note the required liquid line temperature located directly above in area (C). If the measured liquid line temperature is higher than the REQUIRED liquid line temperature ADD refrigerant. If the measured liquid line temperature is lower than the REQUIRED liquid line temperature REMOVE refrigerant.

D

C

FIG. 3D

*E*

Use this method for charging units with a TXV

VISUALLY VERIFY the unit actually has a TXV installed on the inside evaporator coil. Just because the condensing unit specifies a TXV does not ensure there is one inside. *CHECK IT EVERY TIME!*

Measure the liquid line pressure and temperature

1. Set the pointer in area A to the measured liquid line pressure (small line). Use green box for R22 and pink box for R410A.

24
58
(SEE FIG. 4A)
(SEE FIG. 4B)
A
B
C
(SEE FIG. 4C)
(SEE FIG. 4D)
(SEE FIG. 4E)

A
ADD R22
60
70
80
90
72
ADD R410A
110
120
130
140
150
160
70
If pressure is above 90 p.s.i.g., verify until is low side. If pressure is still above 90, see inou
30
35
40
45
50
55
than 120 verify
rom high side.
180
200
220
If p.s.i.g. is lower than 180, verify
gauge reading is from high side.

B
50 160 If pressure is above 160 p.s.i.g., verify gauge reading is from the low side. If pressure is still above 160, see troubleshooting compressors.
unit is R22 & reading is from the
see troubleshooting compressors.
55 60 65 70 75 80 85 90 95 100 105 110
120 140 160 180 200
gauge reading is from high
If p.s.i.g. is lower than 120
220 240 260 280 300 320 340 360 380 400 420 440 460 480

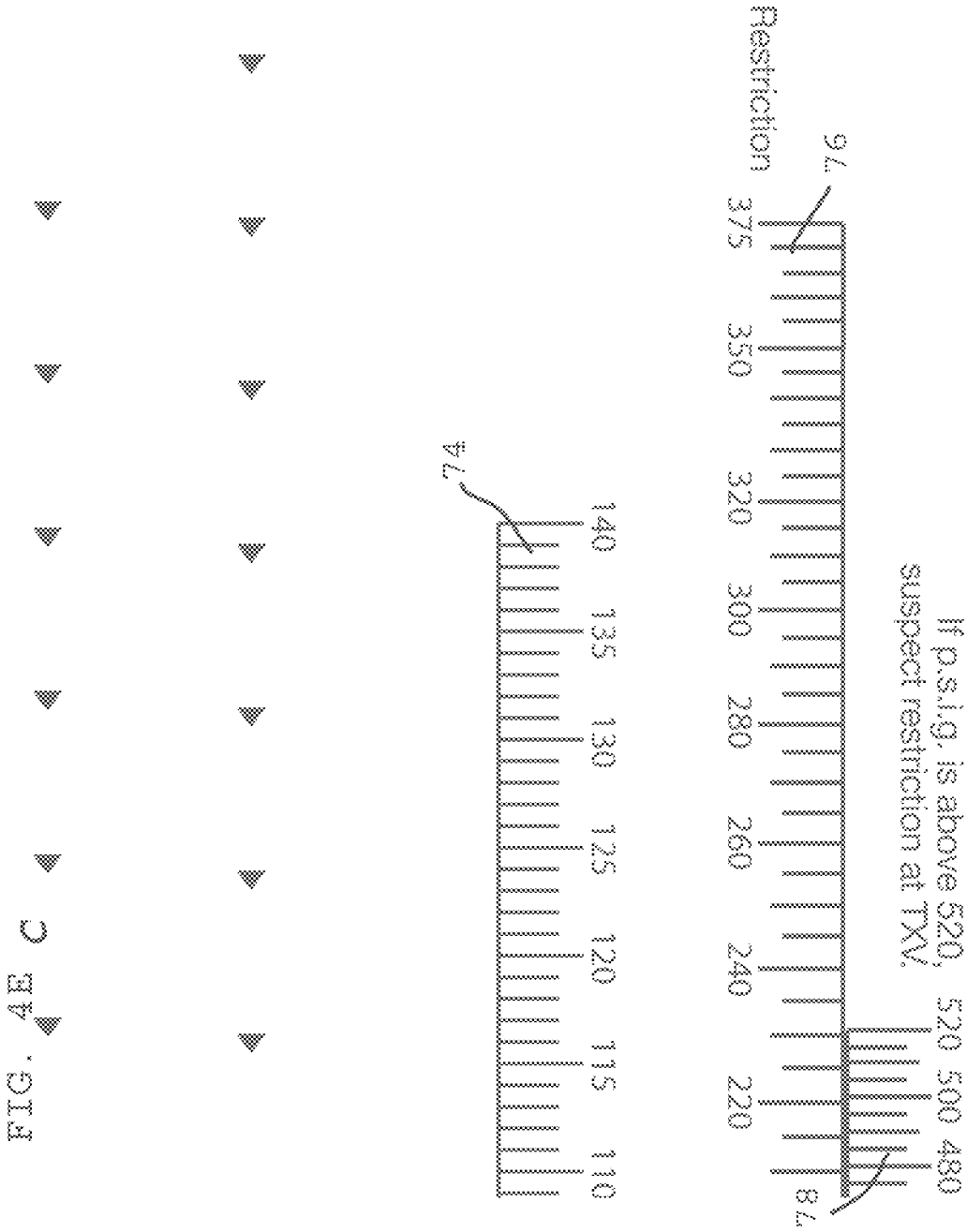
FIG. 4E C

REFRIGERANT CHARGE SLIDE CALCULATOR

CROSS-REFERENCE TO RELATED APPLICATION

The present application is a continuation-in-part of U.S. Provisional Patent Ser. No. 61/634,634, filed Mar. 23, 2012, and invented by Bryan Tod Knowlton of San Angelo, Tex.

TECHNICAL FIELD OF THE INVENTION

The present invention relates in general to air conditioning systems, and in particular to a slide calculator for determining proper refrigerant charge for operating an air conditioning system.

BACKGROUND OF THE INVENTION

Prior art slide calculators have been provided for calculating proper refrigerant charge for refrigeration systems, such as for use in servicing building air conditioning systems for heating and cooling. Typically, the pressure and temperature of the refrigerant at one point in the refrigeration system is measured, and then compared to desired refrigeration performance characteristics to determine whether there is a proper amount of refrigerant within the system. The prior art slide calculators have been used to translate the measured temperature and pressure for comparison in relation to the performance characteristics. However, prior art slide calculators provide data in tabular format that is data tables, rather than graphical representations in which positions in linear and logarithmic scales represent various changes in temperatures and pressures according to corresponding performance characteristics and measured pressures and temperatures. Recently, due to environmental concerns, refrigerants such as R22 have been replaced with new refrigerants such as R410a which are perceived as less harmful to the environment. The older refrigerants utilize hydro fluorocarbons and newer refrigerants utilize difluoromethane. This has resulted in prior art refrigerant charge slide calculators being required for each type of refrigerant being used. This is cumbersome with service technicians often required to carry numerous refrigerant charge slide calculators, at least one per type of refrigerant used. Since prior art slide calculators use tabular forms rather than graphical representations, it is not practical to provide prior art slide calculators with tabular representations in which more than one type of refrigerant is displayed for a refrigerant charge slide calculator.

SUMMARY OF THE INVENTION

A refrigerant slide calculator is disclosed in which the proper refrigerant charge for more than one refrigerant may be determined using a single calculator, with representations for performance characteristics and measured temperatures and pressures displayed on a singular side of the slide calculator for more than one refrigerant. A superheat region and a subcooling region are provided on different portions of a sleeve for the refrigerant charged slide calculator. The superheat region will have a wet bulb temperature window for the interior space being cooled, and a required superheat window based on the ambient dry bulb temperature exterior of the space being cooled. A vapor pressure window is provided for a first type of refrigerant, preferably R22, and a second vapor pressure window is provided for a second type refrigerant, preferably R410a. Then, a singular required vapor line temperature for a corresponding user indexed pressure is displayed in a singular graphical representation line. In the subcooling region, a required liquid line temperature window and a unit required subcooling data field are provided along with a liquid pressure window that is indexed to represent the pressure of the corresponding refrigerant. The sleeve further has a superheat instruction field and a subcooling instruction field for providing instructions for use. The operator is a card which slidably fits within the sleeve. The sleeved superheat data areas and subcooling data areas with various data fields providing desired performance characteristics and measured pressures and temperatures within respective ones of the various windows.

DESCRIPTION OF THE DRAWINGS

For a more complete understanding of the present invention and the advantages thereof, reference is now made to the following description taken in conjunction with the accompanying Drawings in which

FIG. 1 is a side elevation view of a sleeve for a refrigerant charge slide calculator;

FIG. 2 is a side elevation view of an operator for the refrigerant charge slide calculator;

FIGS. 3 and 3A-3E together provide a depiction of a refrigerant slide calculator, by which the various fields for the sleeve may be viewed; and FIGS. 4 and 4A-4E together provide a side elevation view depicting an operator for the refrigerant charge slide calculator.

DETAILED DESCRIPTION OF THE INVENTION

Figure 1:
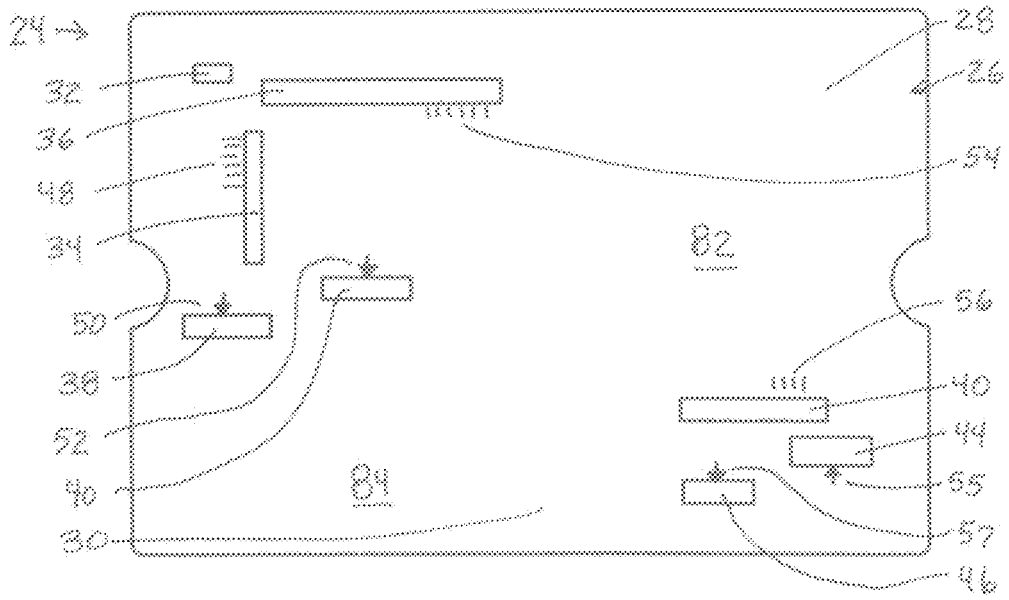
FIGS. 1 through 4 show various aspects for refrigerant charge slide calculator devices made according to the present invention, as set forth below.
Figure 2:
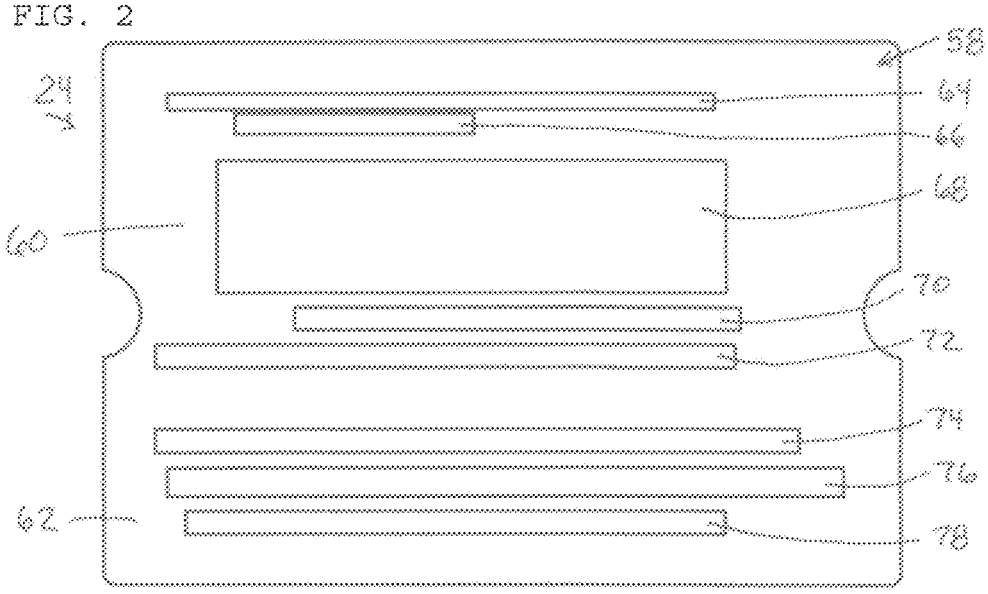
Figure 3:
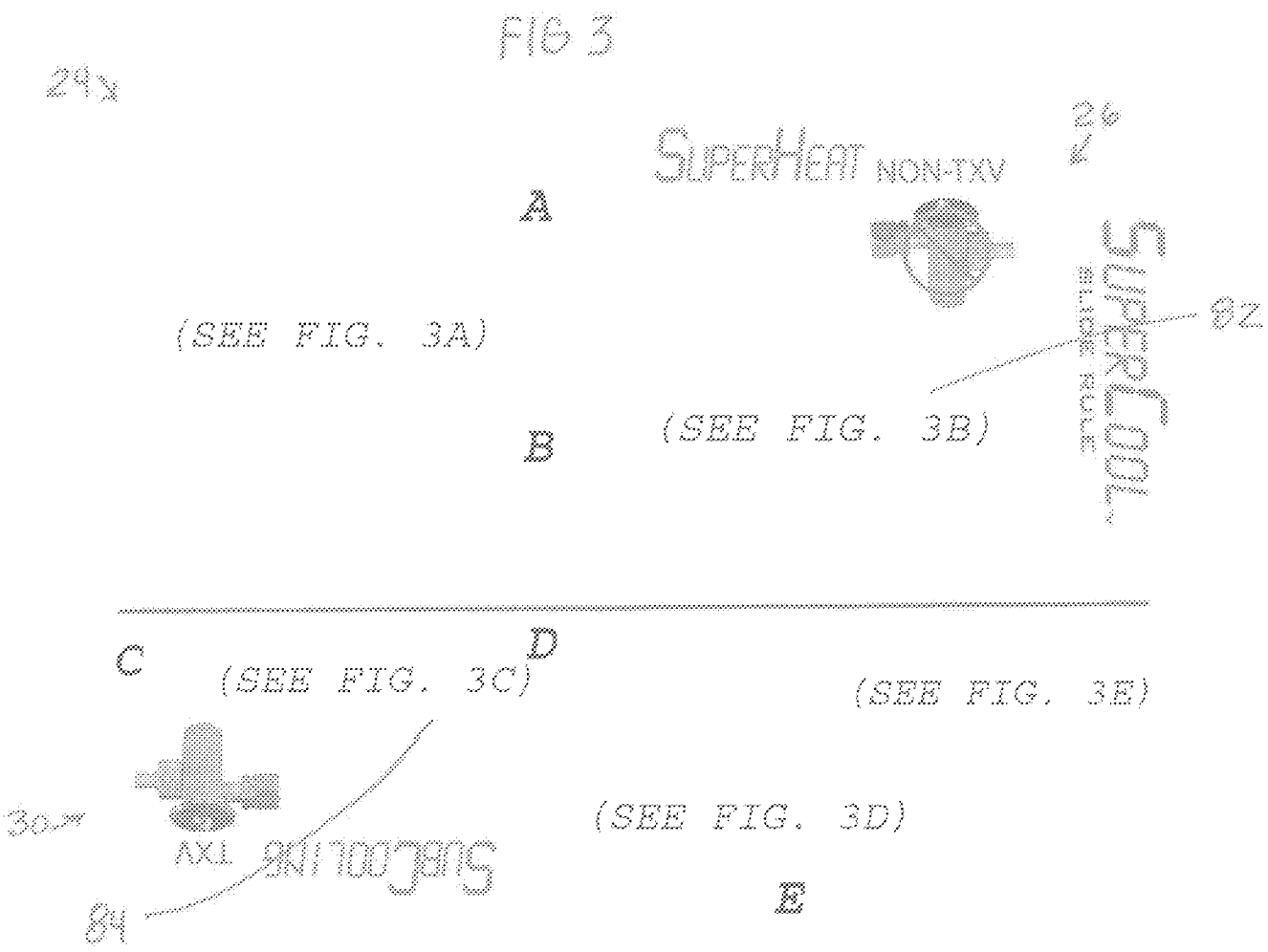
Figure 3A:
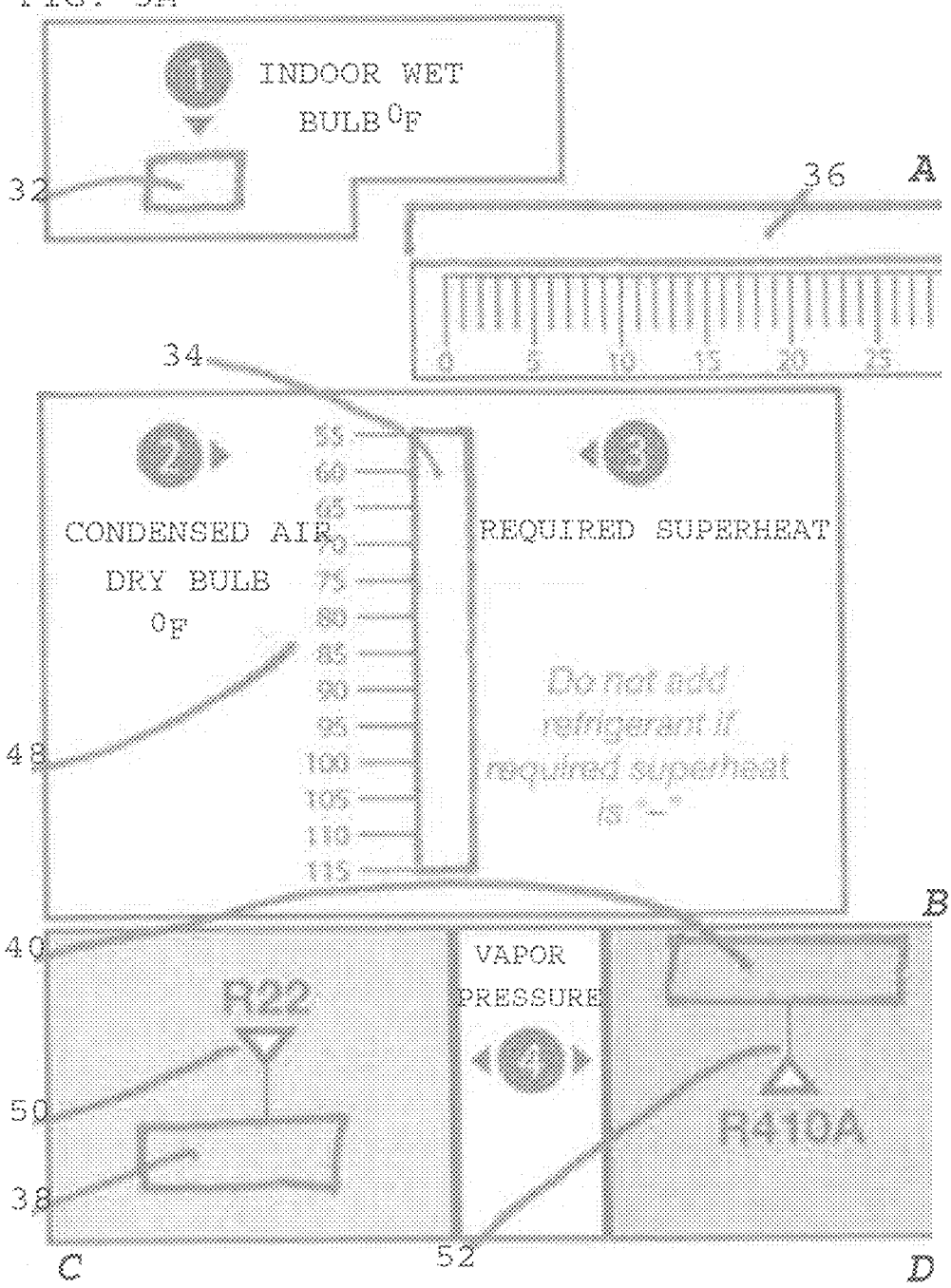
Figure 3E:
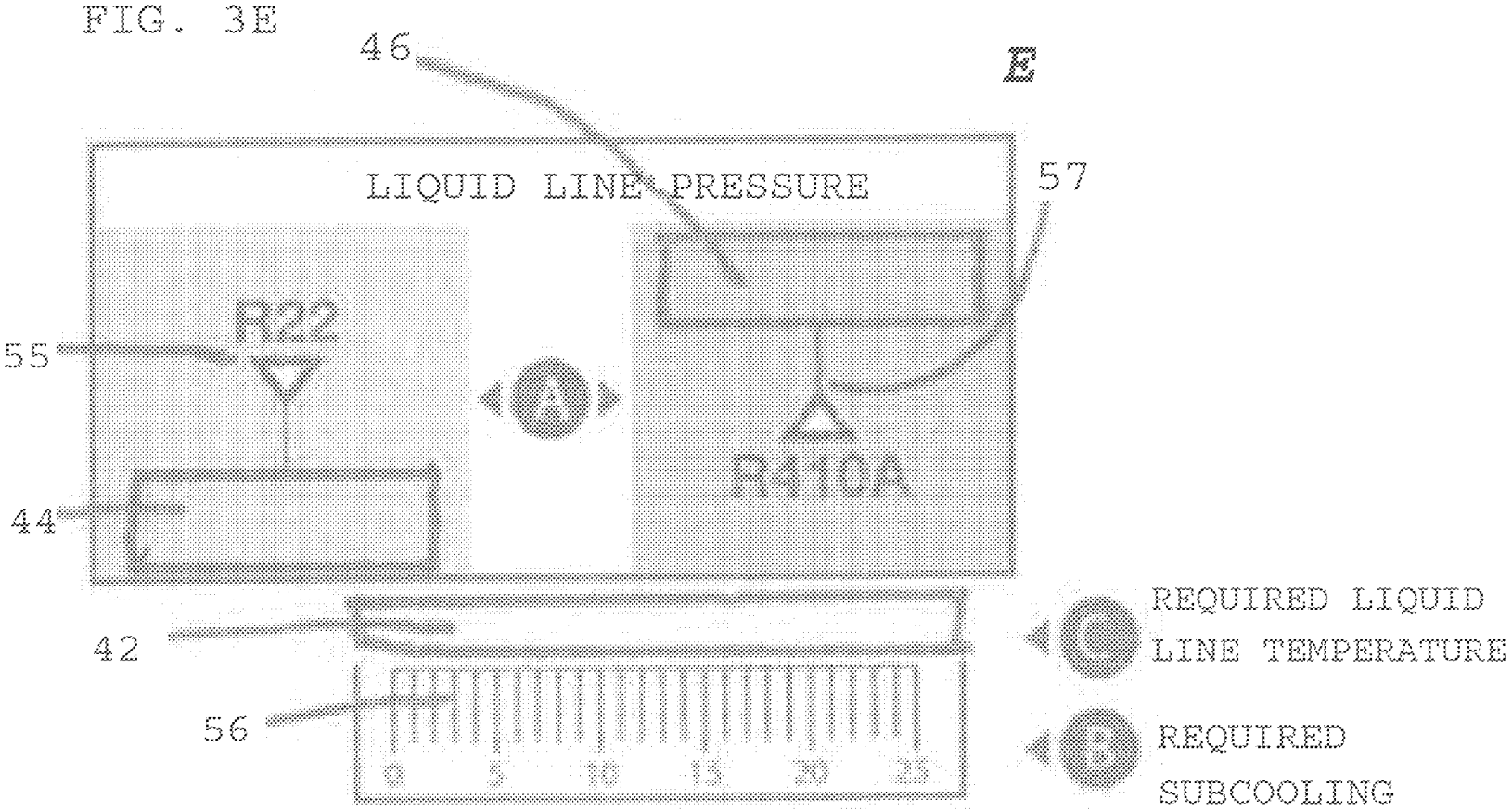
Figure 4:
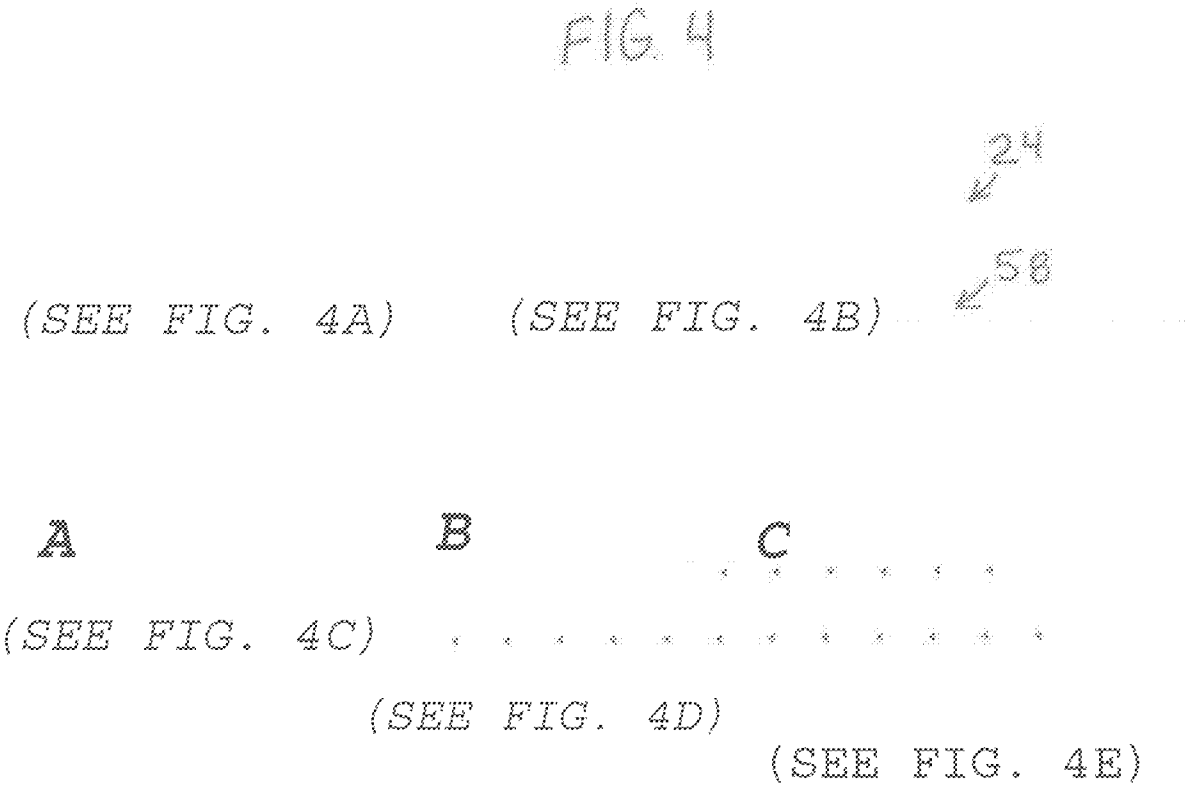
Figure 4A:
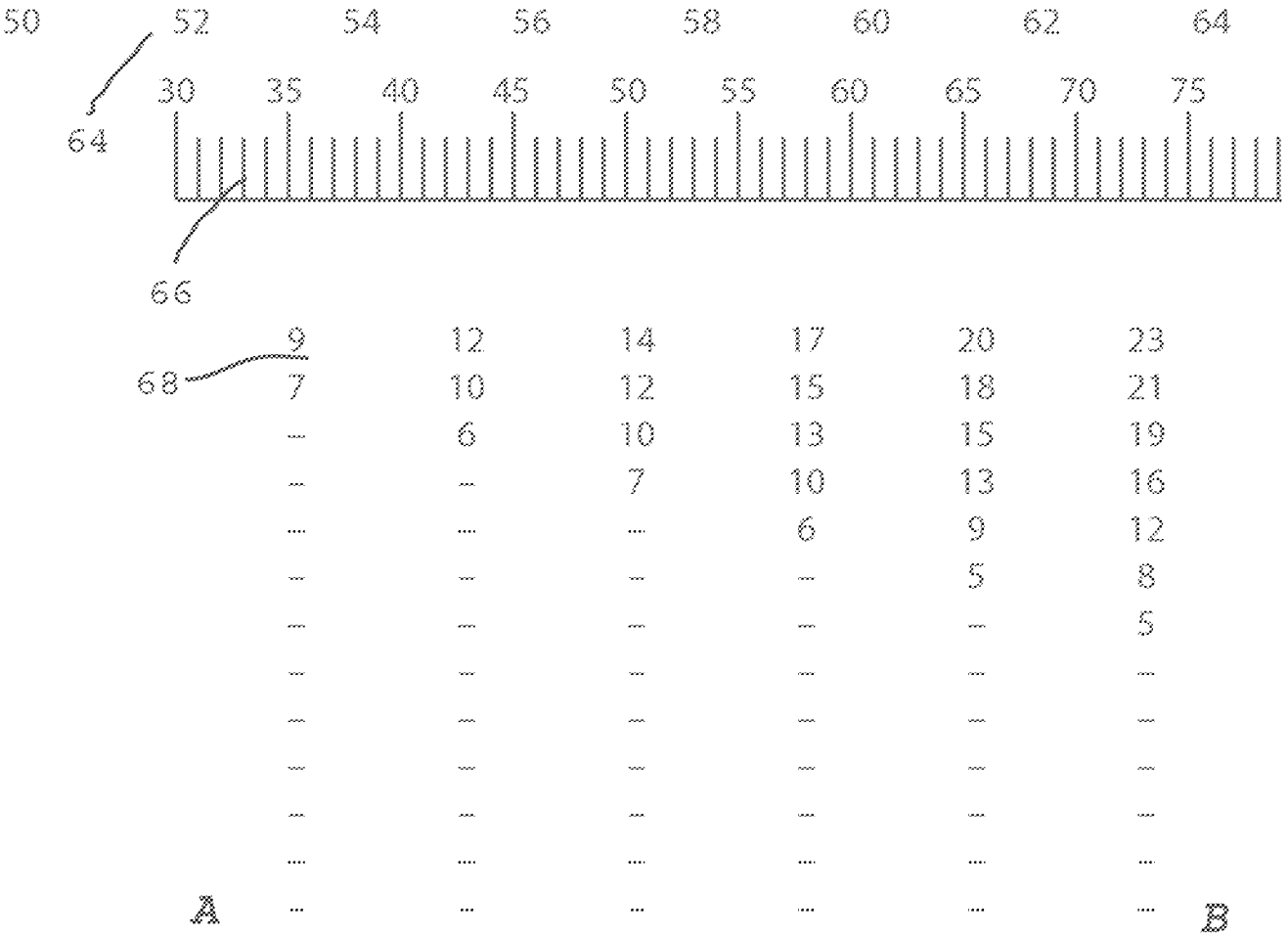
Figure 4B:
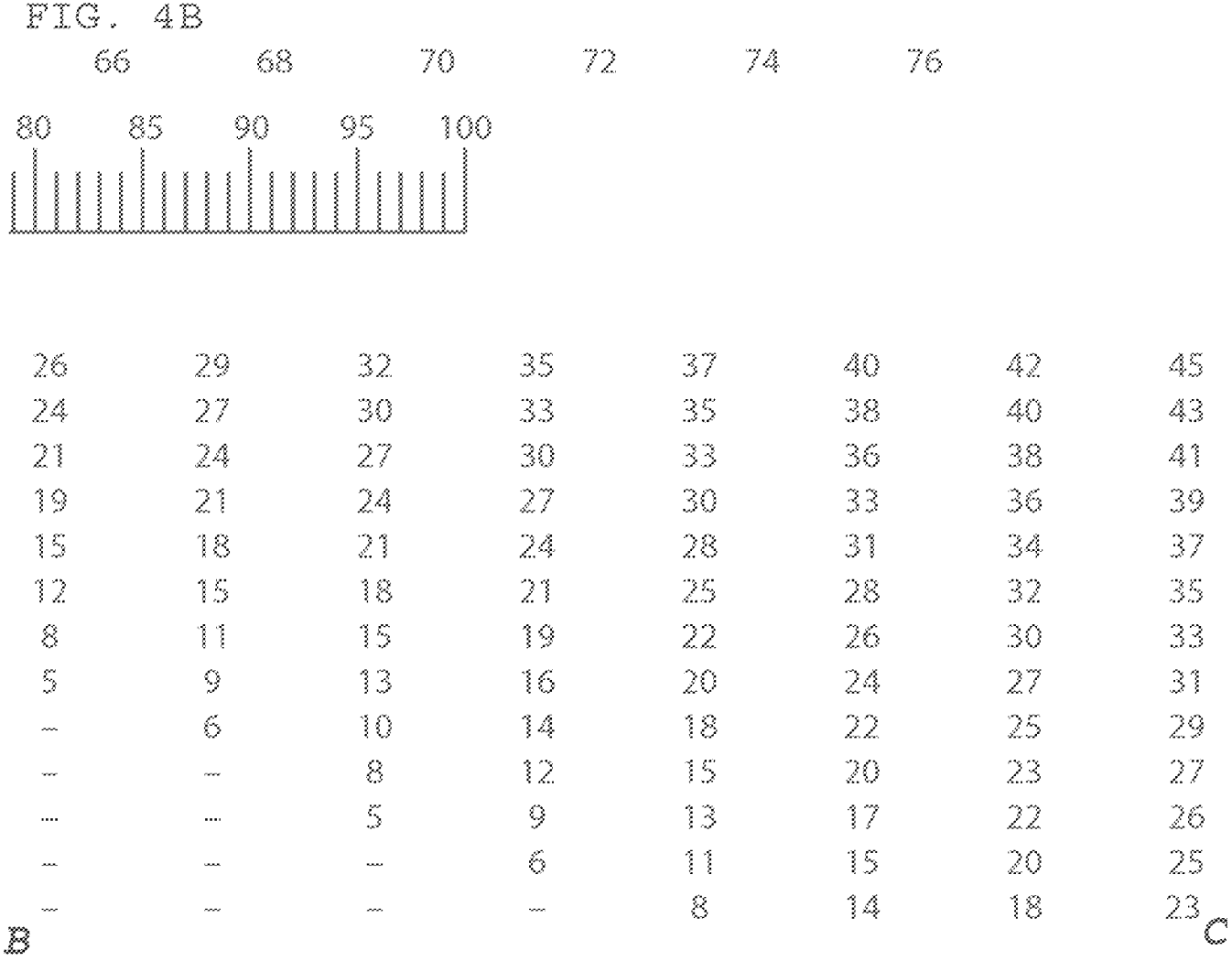
Figure 4C:
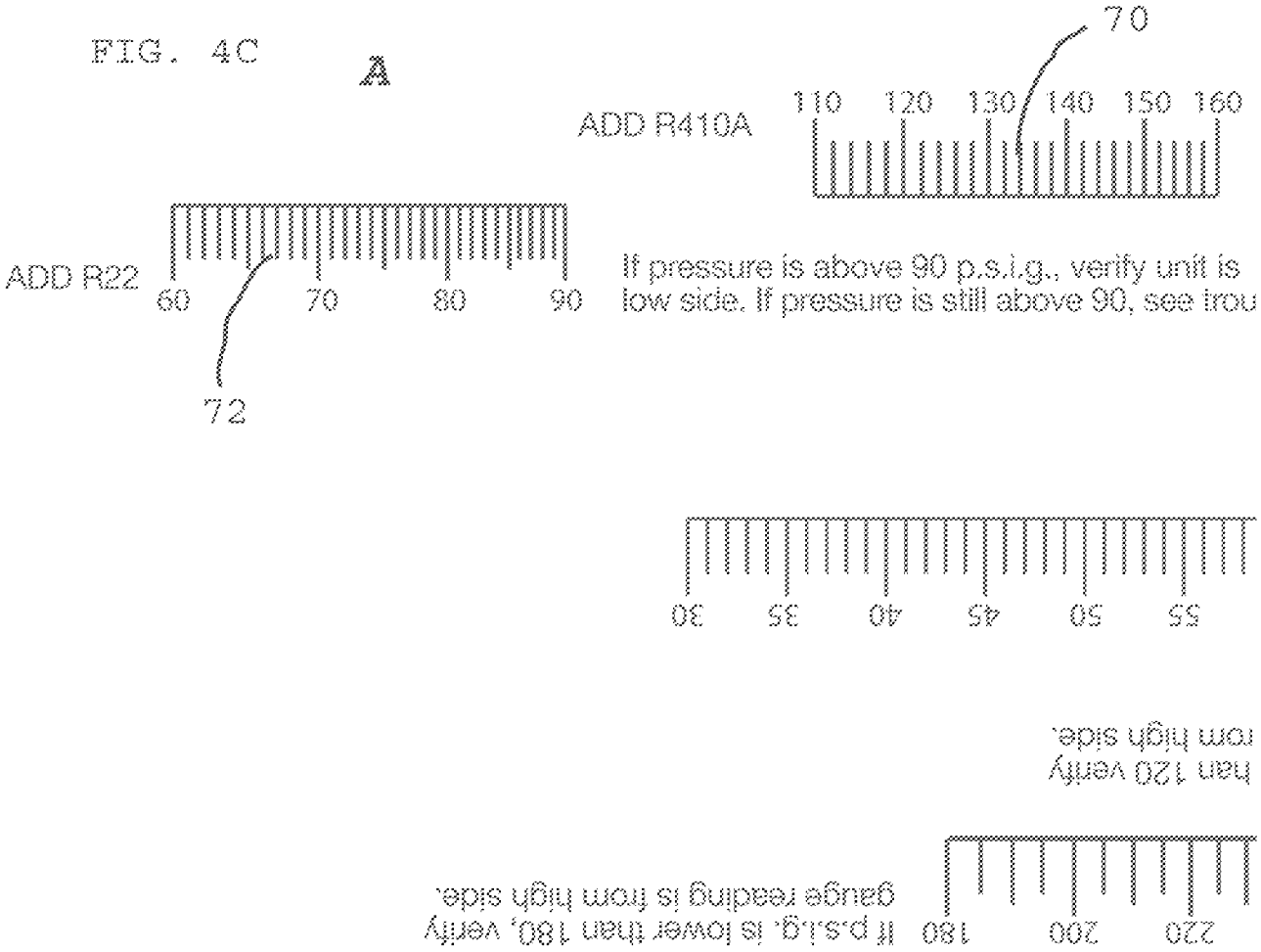
Figure 4D:
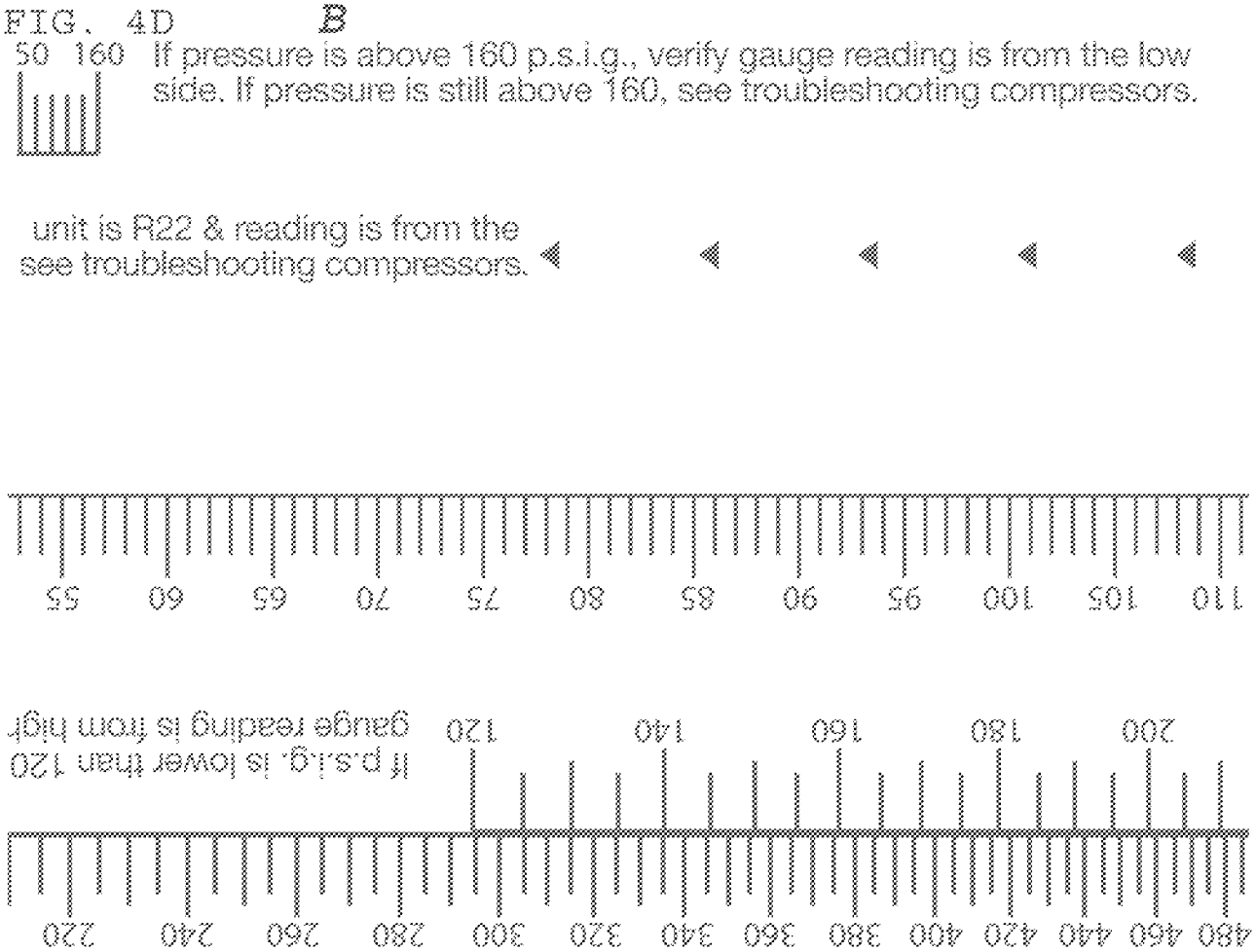

FIGS. 1 and 3 are side elevation views of a refrigerant charge slide calculator having a sleeve 26 and FIGS. 2 and 4 are side elevations view of an operator 58 for the refrigerant charge slide calculator. FIG. 3 is a depiction of a refrigerant slide calculator, by which the various fields for the sleeve may be viewed. The sleeve 26 has a superheat region 28 and a subcooling region 30. The superheat region 28 includes a wet bulb temperature window 32, a required superheat window 34, a required vapor line temperature window 36, and a first window 38 for depicting the vapor pressure for one type of refrigerant, preferably R22, and a second vapor pressure window 40 for depicting a second type of refrigerant, preferably R410a. The subcooling region 30 has a required liquid line pressure window 42, a liquid pressure window 44 for a first type of refrigerant, preferably R22, and a liquid pressure window 46 for a second type of refrigerant, preferably R410a. The superheat region 28 further includes a superheat instruction field 50, in which instructions for operation of the refrigerant slide charge calculator 24 are provided. Similarly, a subcooling instruction field 52 provides instructions within the subcooling region 30 for an operator to use the refrigerant charge slide calculator 24.

The operator 58 is preferably a sliding card which slidably engages within the sleeve 26 for aligning various data fields 64 through 78 with corresponding windows noted above for the sleeve 26. Various performance parameters and characteristics are displayed within or by the windows aligning with various ones of the fields 64 through 78 according to the procedures noted herein below. The operator 58 has the superheat data area 60 and a subcooling data area 62 for aligning with respective ones of the superheat region 28 and the subcooling region 30 of the sleeve 26. The data field 64 corresponds to window 32 for entry of the wet bulb temperature. The data field 66 corresponds to window 36 which provides a listing of the desired vapor line temperature for proper operation of the refrigeration system. The data field 68 corresponds to a tabular listing or tabular format for the required superheat for the unit to operate properly. The data field 70 corresponds to the window 40, the entered vapor pressure for the second refrigerant R410a. The date field 72 corresponds to the window 38 for entry of the measured vapor pressure of the first refrigerant, preferably R22. In the subcooling data area 62, the data field 74 corresponds to the window 42 for display of the desired liquid line temperature for proper operation of the refrigeration system. The data field 76 corresponds to the window 44 for indexing of the liquid line pressure measured of the first refrigerant R22. The data field 78 corresponds to the data field displayed through the window 76 for displaying the measured liquid line pressure of the second refrigerant, preferably R410a.

The superheat region 28 of the refrigerant charge slide calculator 24 is used for refrigeration systems which have pistons with a fixed orifice. First, the required superheating is needed to determine the performance characteristics for the refrigeration system. This is preferably done by taking a wet bulb temperature of the airflow entering the evaporator coil of the system, and measuring the vapor pressure and temperature of the refrigerant at the suction line to the compressor. The indoor wet bulb temperature is indexed in window 32 by sliding the card until it is displayed within the window 32. Then the window 34 is viewed with graduated markings 48 alongside the window 34 to align the dry bulb temperature of the air flow across the condenser with a numerical reading displayed within the window 34. The alignment of the numbers displayed in the window 34 with the window 34 is set by aligning the measured wet bulb temperature within the window 32. The reading in the window 34 then goes through required superheat that is superheat for the refrigerant at the suction line suction of the compressor. Then, the measured vapor pressure at the suction line is set by indexing the correct numeral display with the respective ones of the windows 38 and 40, depending upon which of the refrigerants is contained in the system. For this alignment, the operator 58 is moved within the sleeve 26 until the proper measured pressure aligns respective with markings 50 and 52 within respective ones of the windows 38 and 40. Once the operator is properly aligned within the sleeve 26 such that the proper measured vapor pressure at the suction is aligned with respective ones of the alignment marks 50 and 52, then the window 36 is viewed to determine the required vapor line temperature at the suction for the compressor. Graduation markings 54 are printed along the sleeve 26 immediately beneath the window 36 to find a corresponding required superheat previously determined in window 34. If this temperature is higher than the actual temperature measured, then refrigerant should be added to the system. If the required vapor line temperature actually measures lower than that displayed in the window 36, then refrigerant should be removed from the system and then retested until the measured vapor line temperature closely approximates that of the required temperature at the section.

For subcooling, the subcooling region 30 is used when there is a TXV valve present, that is an expansion valve which regulates the refrigerant flow according to measured parameters. This is well know in the art. Here, the amount of subcooling is either determined by reviewing manufacturer specifications for a particular unit, or using an approximate value such as 8-10 degrees. Then, the liquid line pressure and temperature are measured at one point, on the discharge of the condenser, or prior to the expansion valve, and then the measured pressure of the refrigerant is indexed in the corresponding refrigerant window, for respective ones of the refrigerant windows 44 or 46, depending on the type of refrigerant, to align alignment markings 55 and 57 with the pressures displayed on the operator 58 which are visible through the respective ones of the windows 44 and 46 until the operator is properly aligned with the sleeve 26. Then, the graduated markings displayed on the sleeve 26 beneath the window 42 are viewed for referencing the subcooling and determining the required temperature of the liquid line for proper operation of the refrigeration unit. For subcooling, if the measured temperature is higher than the desired liquid line temperature, then refrigerant should be added. If the measured liquid line temperature is lower than the desired liquid line temperature, then refrigerant should be removed, and the unit retested until it is operating within acceptable ranges.

The present invention provides a refrigerant charge slide calculator 24 for determining when proper charge or whether to add or remove refrigerant from an air conditioning system for both subcooling and superheating on a single side of the charge slide calculator 24 for two different refrigerants. Various temperature data is displayed in graphical presentation on the operator 58 within which is slidably extensible from within the sleeve 26.

Although the preferred embodiment has been described in detail, it should be understood that various changes, substitutions and alterations can be made therein without departing from the spirit and scope of the invention as defined by the appended claims.

What is claimed is:

1. A refrigerant charge slide calculator for determining whether a proper amount of refrigerant is present in an air conditioning system, said refrigerant charge calculator comprising:

a sleeve having a first side, a second side and an interior passage disposed there-between, said interior passage having opposite open ends, and said first side having windows formed therein, with graduation markings and alignment marks disposed adjacent to respective ones of said windows an operator for slidably moving within said sleeve, said operator having data fields for selectively aligning with said windows in said first side of said sleeve in response to aligning values in said data fields with respective ones of said graduation markings and said alignment marks;

said sleeve having a superheat region in which a first of said windows is disposed for aligning a first value of said data fields corresponding to a wet bulb temperature of indoor ambient air which aligns second values of said data fields adjacent to a first set of said graduated markings adjacent a second window corresponding to a dry bulb temperature of outdoor ambient air, wherein said second values of said data field aligned adjacent to said first set of graduated markings corresponds to a required superheat temperature for proper operation of the refrigeration system;

said superheat region of said sleeve further having third and fourth windows with a first set of alignment marks adjacent to respective ones of said third and fourth windows for aligning third and fourth values of said data fields corresponding to vapor pressures of respective ones of a first and a second refrigerants in a compressor suction line, which aligns fifth values of said data fields with a second set of graduated markings adjacent a fifth window representing said required superheat temperature determined from said wet bulb temperature and said dry bulb temperature in reference to said first and second windows, wherein one of said fifth values of said data fields is aligned to a corresponding one of said second set of graduated markings representing said required superheat temperature and said one of said firth values is thereby determined to represent a required vapor line temperature for proper operation of the air conditioning system; and said sleeve further having a subcooling region having sixth and seventh windows with a second set of alignment marks adjacent to respective ones of said sixth and seventh windows for aligning sixth and seventh values of said data fields with corresponding ones of said second set of alignment marks adjacent respective ones of said sixth and seventh windows, which aligns eighth values of said data fields with a third set of graduated markings adjacent an eighth window, wherein a particular value of said eight values of said data fields which is located in alignment with a particular one of said third set of graduated markings representing a required subcooling provides a required liquid line temperature for proper operation of the refrigeration system.

2. The refrigerant charge slide calculator according to claim 1, further comprising a superheat instruction field disposed in said superheat region and a subcooling instruction field disposed in said subcooling region.

3. The refrigerant charge slide calculator according to claim 1, wherein a portion of said data fields of said operator representing the measured wet bulb temperature, said required vapor line temperature for proper operation of the refrigeration system and said required liquid line temperature for proper operation of the refrigeration system are graphically displayed, with temperature graduations of equal temperature changes spaced equal distances apart.

4. The refrigerant charge slide calculator according to claim 3, wherein a second portion of said data fields of said operator representing measured vapor line pressures and measured liquid line pressures are spaced with pressure graduations spaced varying distances for equal pressure changes.

5. The refrigerant charge slide calculator according to claim 1, wherein said superheat region is used for refrigeration systems having expansion orifices which are variable in size during operation and said subcooling region is used for refrigeration systems having expansion orifices of fixed size.

* * * * *